United States Patent [19]

Maggiorana

[11] 4,155,333

[45] May 22, 1979

[54] CENTRIFUGAL WATER PUMP FOR INTERNAL COMBUSTION ENGINES

[75] Inventor: Mario Maggiorana, Highland Park, Ill.

[73] Assignee: Brunswick Corporation, Skokie, Ill.

[21] Appl. No.: 785,443

[22] Filed: Apr. 7, 1977

[51] Int. Cl.[2] ..... F01P 5/10

[52] U.S. Cl. ..... 123/41.44; 123/41.46; 123/41.47; 123/90.31; 415/205

[58] Field of Search ..... 123/41.44, 41.46, 41.47, 123/90.31; 415/205

[56] References Cited

U.S. PATENT DOCUMENTS

| | | | |
|---|---|---|---|
| 54,937 | 5/1866 | Miller | 415/205 |
| 1,461,711 | 7/1923 | Bull | 123/41.47 |
| 2,214,243 | 9/1940 | Casson | 123/41.46 |
| 2,680,409 | 6/1954 | Sebens | 415/205 |
| 3,001,517 | 9/1961 | Baker | 123/41.47 |
| 3,871,790 | 3/1975 | Rameau | 123/41.47 |

FOREIGN PATENT DOCUMENTS

| | | | |
|---|---|---|---|
| 131 | 2/1914 | Netherlands | 123/41.47 |

*Primary Examiner*—Charles J. Myhre
*Assistant Examiner*—Jeffrey L. Yates
*Attorney, Agent, or Firm*—Andrus, Sceales, Starke & Sawall

[57] ABSTRACT

A centrifugal water cooling pump unit mounted to the front cover of an internal combustion engine and is connected directly to the camshaft. The pump unit includes a special intake chamber overlying an impeller having straight radial blades with inner ends spaced from the axis of rotation. The intake chamber is formed with a spiral discharge passageway to direct the water spirally about the impeller axis of the impeller, with the water introduced into the impeller adjacent the radially inner ends of the radial blades. A pair of shaft seals are provided in the front cover with a telltale opening therebetween to indicate leakage from the water pump. The impeller is formed of plastic to the end of the pump shaft by a clamping nut. A bell-shaped washer is interposed between the impeller and nut to limit the pressure made on the plastic impeller.

7 Claims, 6 Drawing Figures

CENTRIFUGAL WATER PUMP FOR INTERNAL COMBUSTION ENGINES

BACKGROUND OF THE INVENTION

This invention relates to a centrifugal pump apparatus particularly adapted for coolant circulation through an internal combustion engine.

Internal combustion engines are conveniently provided with a recirculating water cooling system to limit the operating temperature of the engine. Centrifugal pumps coupled to be driven from the engine crankshaft are widely employed. Various drive connections have been provided between the crankshaft and the cooling pump. Although belt drive or couplings are widely employed, gear couplings to the crankshaft or to other auxiliary shafts have been suggested. A direct gear drive, for example, is disclosed in U.S. Pat. No. 3,001,517 where the cooling pump is coupled by suitable gearing to the end of an engine cam shaft. Although such pump structure has provided adequate cooling, there is a need for a compact mounting to the forward engine wall with convenient coupling to the internal combustion engine.

Generally, pumps of a centrifugal type employ a bladed impeller mounted within a pump housing having a suitable inlet and outlet for circulating of the water through the engine block. Various pump inlet-outlet configurations have been suggested for maximizing the efficiency of the pump operation. For example, the impeller may be formed with specially designed spiral blades which in combination with specially shaped chambers create a smooth flow with minimum cavitation. Although efficient systems have been developed, the special configurations of the impeller and the like result in relatively costly manufacturing processes with a relatively expensive pump construction.

There remains therefore, the need for a simplified centrifugal water pump which can be economically manufactured while maintaining a high degree of efficiency to permit connection as a water cooling source to an internal combustion engine or the like.

SUMMARY OF THE PRESENT INVENTION

The present invention is particularly directed to a centrifugal pump apparatus which is particularly adapted to incorporation and connection to an internal combustion engine. Generally, in accordance with the present invention, the pump apparatus includes a pump housing having a special intake chamber overlying an impeller having straight radial blades. The intake chamber is formed with a spiral discharge portion and is located over the central portion of the impeller, such that the incoming water is directed in a spiral fashion projecting axially inwardly toward the impeller and spirally about the axis of the impeller, with the water introduced into the impeller adjacent the radially inner ends of the radial blades. The inventors have found that this provides a highly efficient introduction of the water into the impeller and in particular, essentially eliminates cavitation without the development of special spiral blades.

In a particularly unique embodiment for an internal combustion engine, the water pump is formed with a three-piece pump housing including an inner or base plate which is preferably integrally formed as part of the front engine cover of a conventional multiple cylinder internal combustion engine. The pump shaft is formed as an extension of the cam shaft and extends outwardly through the base plate. A pair of axially spaced shaft seals are located in the base plate to seal the cam shaft chamber from the water pump. An opening to the atmosphere from between the seals provides indication of any leakage of the inner seal and an initial warning of a potentially dangerous condition. An intermediate impeller cover is interconnected to the base cover with internal walls configured to define a generally cylindrical pumping chamber within which the impeller is rotatively mounted. The impeller cover includes a cylindrical wall defining a center inlet, opening to the impeller chamber. The impeller includes a base plate having the impeller blades which are straight, flat blades, extending from the outer edge of the plate and terminating in spaced relation to the central hub portion of the impeller. The blades include an angled or inclined portion and a radial outer portion conforming to the impeller cover. The outer intake cover is secured to the impeller cover and includes a spiral intake chamber, having a generally diametrically directed inlet which then extends in a spiral manner about the axis of the impeller and also extends or moves inwardly to direct the water into the impeller centrally thereof, and in the preferred embodiment to the inner edge of the radial blades.

According to a further novel feature of the preferred embodiment of the present invention, the impeller is clamped to the end of the pump shaft by a clamping nut which is secured to the shaft. A bell-shaped washer is interposed between the impeller and the clamping nut such that the bell-shaped washer is flattened upon tightening of the nut to limit the pressure made on the pump impeller. This novel structure permits use of a plastic impeller by limiting stresses associated with overtightening of a retaining nut.

The present invention provides a highly efficient centrifugal pump for a water cooling system and in the preferred construction is particularly adapted to mounting as an integrated, compact and esthetically pleasing pump secured directly to the engine block.

BRIEF DESCRIPTION OF DRAWINGS

The drawings furnished herewith illustrate the best mode presently comtemplated by the inventor for carrying out the invention in which the above advantages and features are clearly disclosed as well as others which will be readily understood from the description of such illustrated embodiment.

In the drawings.

DESCRIPTION OF THE ILLUSTRATED EMBODIMENTS

Figure 1:
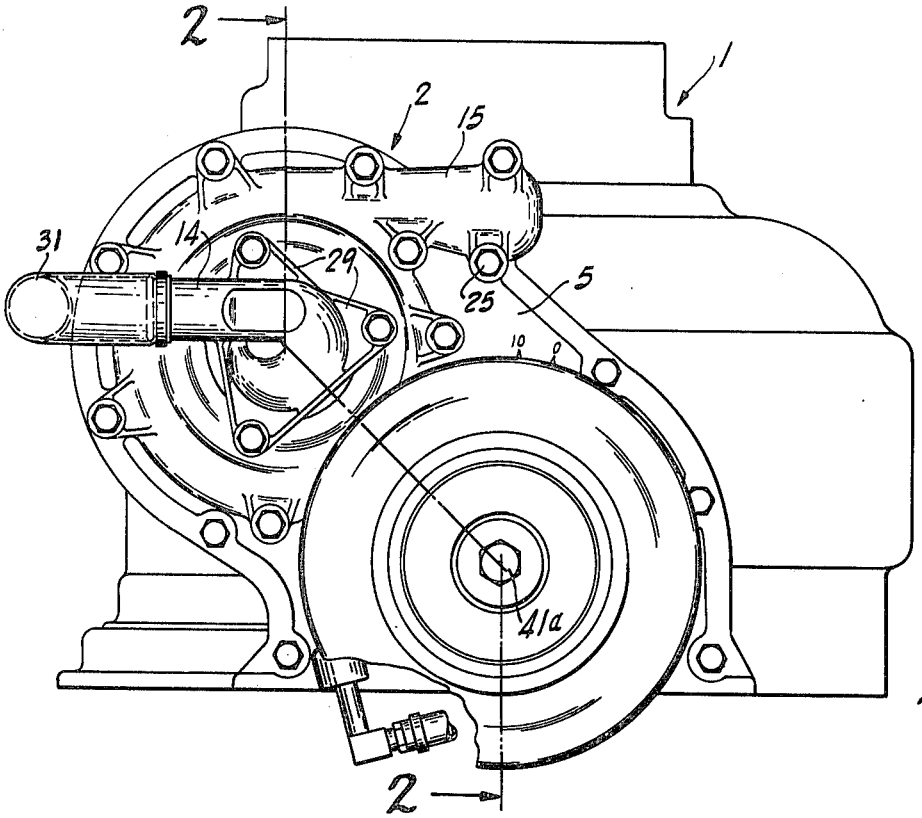
FIG. 1 is a front elevational view of an internal combustion engine with a water pump constructed in accordance with the teaching of the present invention and secured as an integrated part to the front of the engine block.
Figure 3:
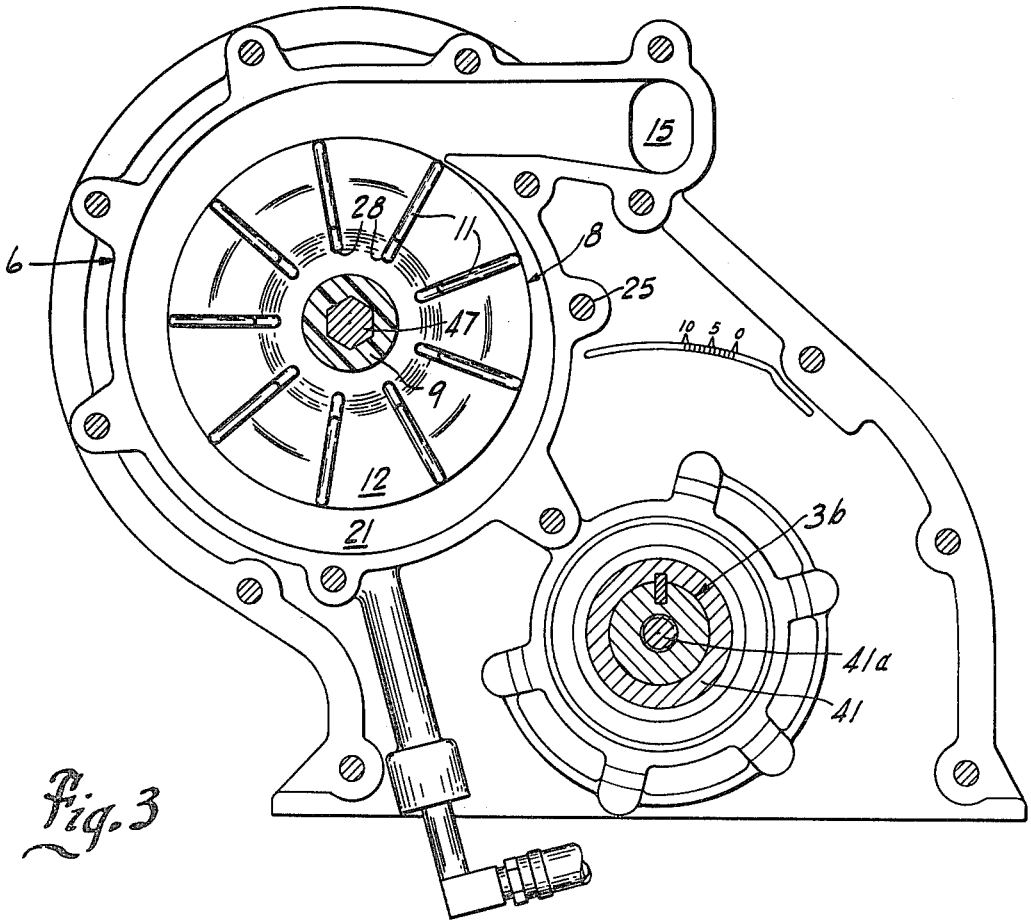
FIG. 3 is a section taken on line 3—3 of FIG. 2 and showing a pump base plate construction.
Figure 2:
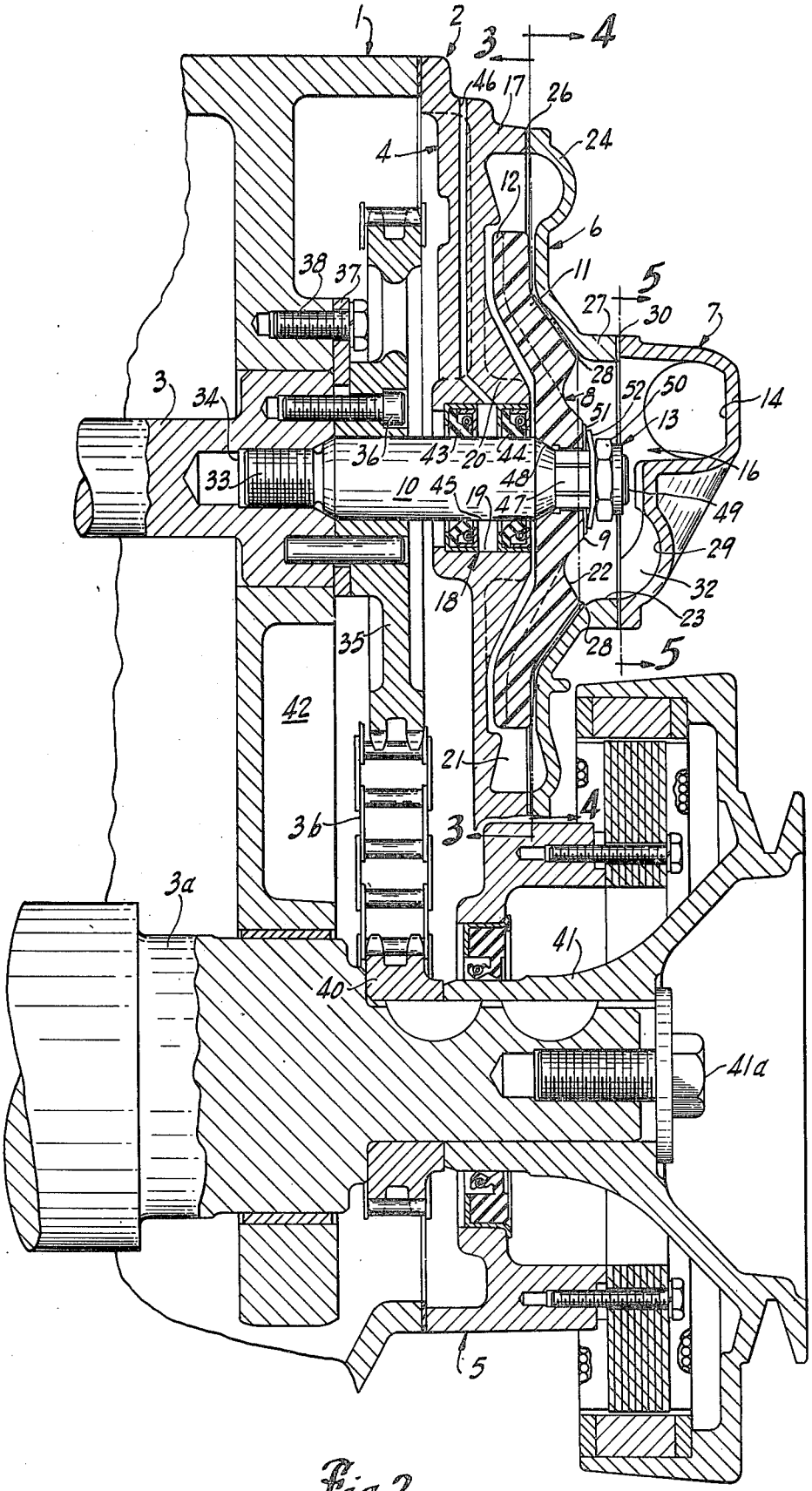
FIG. 2 is an enlarged vertical section taken generally on the line of 2—2 of FIG. 1.
Figure 4:
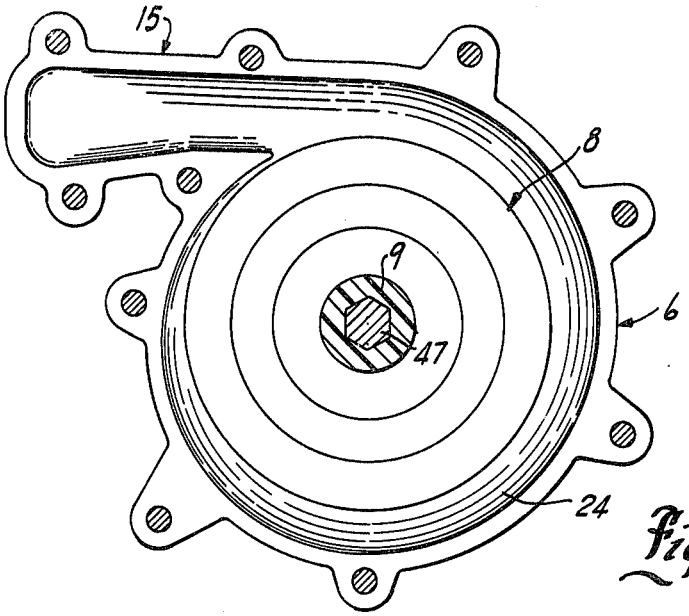
FIG. 4 is a section taken on line 4—4 of FIG. 2 and showing a pump impeller cover connected to the base plate.

Referring to the drawings, and particularly to FIGS. 1 and 2, a fragmentary portion of an internal combustion engine 1 is shown with a water cooling pump 2 integrally secured to the front of the engine block to form an integrated part of the internal combustion engine. The illustrated engine is typical of a multiple cylinder engine employed in marine inboard-outboard drives. The engine includes a cam shaft 3 for controlling the fuel supply system to the several cylinders. The cam shaft 3 is coupled in any suitable manner to be driven from the engine crank shaft 3*a* and provide appropriate timing of the engine operation. In FIG. 2, the crank shaft 3*a* and camshaft 3 are directly coupled by a chain drive 3*b*. The present invention is particularly directed to a unique water pump construction and water pump unit 2 illustrates a preferred construction thereof. The engine 1, therefore, is not otherwise described other than as necessary to fully describe the illustrated embodiment of the present invention.

Generally, the illustrated pump unit 2 includes an outer pump housing which is formed as a three-part element including an inner base 4 which is cast as an integral part of the engine front cover 5, an intermediate impeller cover 6. and an outer water inlet cover 7. The several covers 4–7 are interconnected to define an impeller chamber within which impeller 8 is rotatively supported. The impeller 8 includes a mounting hub 9 fixedly secured to the pump shaft 10 which is directly coupled to the cam shaft 3. The impeller 8 also includes a plurality of radial impeller blades 11 integrally formed with a base portion 12. The impeller hub 9 is locked on the impeller shaft 10 by a unique pressure limit nut 13 permitting use of a plastic impeller. The water inlet cover 7 has a water connector 14 connected to the discharge side or outlet from the engine water circulating passageway and an outlet connector 15 connected to the inlet to the engine cooling passageway. The inlet cover 7 forms an inlet chamber 16 especially formed as to define a spiral path extending from the water inlet connector 14 about the impeller 8 and directing or forcing the water into the impeller 8 essentially immediately adjacent to the central portion and particularly the inner ends of the radial blades 11. The combination of the water inlet and the radial blade impeller provides a highly efficient centrifugal pump which can be conveniently and economically produced. Generally, the spiral introduction of the inlet water into the central portion of the impeller 8 and the straight radial impeller blade 11, in contrast to the more conventional spiral blades, significantly minimizes cavitation within the pump.

More particularly in the illustrated embodiment of the invention, the front engine cover 5 is formed or integrally cast with a raised or outwardly projecting cylindrical wall 17 defining the base 4 of the water pump 2. A rotating seal assembly 18 is formed within the shaft opening 19 in the base 4 to seal the opening through which shaft 10 extends into the impeller chamber. The base 4 generally conforms with the shape of the impeller 8 and in the illustrated embodiment includes a generally conical or inclined central portion 20 adjacent to the seal assembly and an outer radial portion which has an outermost spiral surrounding passageway 21 to which the water is centrifugally directed by the impeller 8. The water is thus forced to flow around the outer spiral surrounding passageway 21 to the outlet connector 15 for supplying of water to the engine cooling system.

The impeller 8 is formed with the hub 9 which is secured to shaft 10 by the attachment nut unit 13. The impeller 8 is integrally formed with the generally conical plate-like base 12 complementing the conical base plate portion 20 and an outer radial portion. The outer radial portion ends at the outlet passageway 21. The radial blades 11 are integrally cast to the base 12 with the innermost edge 22 of the blades radially offset or spaced from the hub portion 9. In the illustrated embodiment, the innermost edge of the blade is aligned with an opening 23 in the intermediate impeller housing member or cover.

The impeller cover 6 is thus an annular housing member having a central body portion generally shaped to the configuration of the radial blades and an integrally formed outer semi-circular, curved outlet wall portion 24 forming the outer wall of the outlet spiral portion 21 of base 4. The wall portion 24 is also formed to reduce the passageway 21 to the discharge opening or outlet 15, as shown in FIG. 2. The impeller cover 6 is bolted or otherwise secured to the engine front cover as at 25 with a suitable gasket 26 therebetween. The center opening 23 of the impeller cover 6 is formed with a short tubular wall 27 aligned with the outer edges and particularly the outer corner of the radial blades 11, to form an inlet extension to the inlet cover.

More particularly, as most clearly shown in FIG. 2, the impeller hub 9 is generally a flat, heavy portion having a flat bottom wall and a smaller flat upper wall defining a clamping surface for the nut assembly 13. The flat upper wall is located just within the cylindrical opening 23 and wall 27 and an inclined sidewall extends therefrom into the pump chamber. The blades 11 are similarly integrally connected to the base and hub portions. Each blade 11 has the innermost edge 22 formed with the outer corner 28 immediately adjacent to the interior surface of the projecting wall 27. The edge 22 extends radially and axially inwardly across the radially outer portion of the inlet opening 23 to the inclined surface of the hub 9. The radial blades 11 include inclined or angled portions extending outwardly from the edges 22 to radial portions integrally formed with the correspondingly shaped base 12, and thus in close spaced relation to the cover 6 to define confining passageways between the blades which terminate adjacent to the inner periphery of the surrounding discharge passageway 21.

Figure 5:
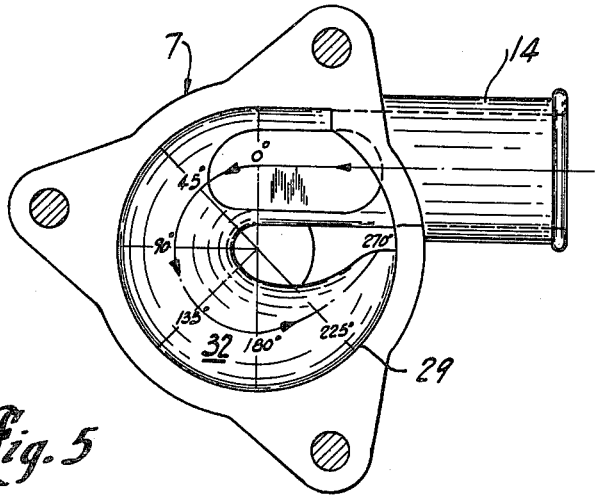
FIG. 5 is a section taken generally on the line 5—5 of FIG. 2 and showing the water inlet cover.
Figure 6:
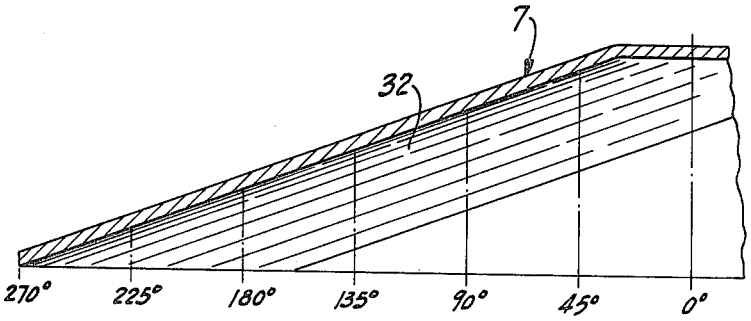
FIG. 6 is a developed view of the intake chamber shown in FIG. 5.

The illustrated inlet cover 7 includes an outer mounting flanges 29, which are bolted or otherwise secured to the impeller cover 6 with a sealing gasket 30 therebetween. The inlet cover 7 includes the inlet connector 14 which is connected to the water hose 31 of the engine cooling system and extends generally across the cover 7 on a line overlying the hub 9 of the impeller 8 and to one side of the shaft 10. The inner surface 32 of the cover 7 is developed with a spirally shaped and axially directed wall, as shown in FIGS. 2, 5 and 6, which defines a corresponding smooth path for the incoming water. The water flows inwardly into the cover 7 and is positively directed in the spiral path about the axis of the hub 9 and axially inwardly into the impeller chamber formed by housing members 4 and 6. As shown most clearly in FIG. 2, the water is particularly directed into the impeller 8 at the innermost edges of the radial blades 11 and immediately adjacent to the effective pumping portion of the impeller 8. Thus, the outer or exterior wall of the cover 7 spirals axially inwardly with a smooth gradual development to force the water into the desired path. A highly satisfactory development is shown in FIGS. 5 and 6. This introduces the water with a minimum of cavitation. The impeller 8 with the conical construction directs the water axially inwardly and radially outwardly to the generally radial portion and then outwardly into the spiral outlet chamber 21. The lack of cavitation results in an efficient pumping action with a full flow of the cooling water through the engine 1.

The impeller shaft 10, in the illustrated embodiment of the invention, is coupled directly to the cam shaft 3 and driven thereby, as follows. The inner end of the impeller shaft 10 is threaded as at 33 and threads into a correspondingly threaded opening 34 in the cam shaft 3. The pump shaft 10 threads in the opposite direction of engine rotation to provide firm interconnection therebetween. The cam shaft 3 is driven from crank shaft 3*a* by the chain drive. As shown in FIG. 2, the drive includes a sprocket 35 connected to the end of the cam shaft 3 as by bolts 36, with a bearing plate 37 interposed therebetween and bolted to the engine block as at 38. A chain connects sprocket 35 to a sprocket 40 which is keyed to the crank shaft 3*a*. A direct driven alternater rotor 41 is bolted to the end of the crank shaft 4 to secure the assembly in position, as at 41*a*. The impeller shaft 10 extends through an appropriate opening provided in the sprocket 35 to provide a compact mounting of the water pump 2 to the front of the engine 1. The impeller shaft 10 extends outwardly from the cam shaft coupling chamber 42 through the seal unit 18. In the illustrated embodiment of the invention, the seal unit 18 is specially constructed with a pair of spaced shaft seals 43 and 44. Each of the seals 43 and 44 are similarly constructed as well-known spring-loaded lip seals within the shaft opening 19. The spacing therebetween defines a seal leakage sensing gap 45. A vent opening 46 is provided in the front engine cover 4 from the gap 45 between the seals and extends outwardly to the exterior of the pump housing, as shown in FIG. 2. Water flowing from the vent passageway 46 will provide an indication of the breakdown of the outermost seal 44 and provides a direct warning of a potentially dangerous condition. Thus, water should not be permitted to enter the cam or shaft coupling chamber 42.

The shaft 10 extends outwardly from the seal unit 18 and is preferably coupled to the impeller 11 by special attaching unit 13 of the illustrated embodiment. The outer end of the impeller shaft 10 is formed with a hex shaped end 47 and an adjacent frustoconical portion 48. The impeller hub 9 includes a correspondingly shaped opening which fits over the head 47 and conical portion 48. The shaft 10 includes an outer threaded extension 49 which receives the clamping nut 50 for firmly fixing of the impeller 8 to the shaft 10. In accordance with a unique feature of the illustrated embodiment, a shim or bearing washer 51 abuts the outer surface of the impeller hub 9. A belleville or dished spring 52 is interposed between the shim washer 51 and the clamping nut 50. The spring 52 thus has the outer peripheral edge abutting the hub washer 51 and the inner peripheral edge abutting the nut 50. When the nut 50 is tightened onto the shaft 10 the dished washer 52 is forced down and flattens to establish a level clamping pressure on hub 9. The constant pressure limits the stresses on the impeller 8 and the inventor has found that with this construction a plastic impeller can be used without requiring severe precautions in the clamping of the impeller to the shaft.

In summary, the water pump with the straight bladed impeller and the spiral intake chamber located over the center of the impeller and particularly the inner edges of the impeller blades, provides a highly efficient flow of the water. The three piece pump housing including the base plate integrally cast with the engine front engine cover of a conventional multiple cylinder internal combustion engine provides an economical, compact and esthetically pleasing construction.

Thus, particularly in the preferred construction, the present invention provides an improved centrifugal pump for an internal combustion engine.

Various modes of carrying out the invention are contemplated as being within the scope of the following claims, particularly pointing out and distinctly claiming the subject matter which is regarded as the invention.

I claim:

1. In combination, an internal combustion engine having an engine crankshaft and having a front engine cover and a water pump unit mounted to said forward engine cover, said water pump unit comprising a base housing member integrally formed with said engine front cover with a shaft opening, an intermediate pump housing member secured to the base housing member and defining an impeller chamber and having an inner wall forming a central water inlet opening concentric of said shaft opening and having an outer outlet passage wall, an impeller shaft rotatably mounted in said shaft opening and terminating in said chamber, means enclosed by said engine cover connecting the shaft to the engine crank shaft, an impeller unit secured to said impeller shaft and located within said chamber, said impeller unit having a base member and a plurality of circumferentially spaced radial blades each extending on a radial line from the axis of said impeller shaft, each of said blades having an inner end spaced from the base member and generally aligned with said central opening, and an impeller inlet cover secured to said inner wall and having an inlet connector having a connector opening introducing water into the cover on a path extending across the cover to one side of the impeller shaft and having a spiral outer passageway wall extending from the connector opening axially inwardly to the inlet opening and terminating in overlying relationship to the inner ends of the radial blades and thereby introducing said water into the impeller at the inner ends of the radial blades.

2. The combination of claim 1 wherein said front engine cover is secured over a camshaft, said impeller shaft being connected directly to said camshaft.

3. The combination of claim 2 wherein said camshaft and impeller shaft are connected by a threaded connection means and includes a threaded end on one of said shafts and a threaded opening in the other of said shafts.

4. In the combination of claim 2 including a shaft seal unit in said shaft opening in said engine cover and including a pair of axially spaced shaft seals, and an indicating passageway in said cover extending from said opening between said seals to the exterior of said cover to provide a water stream upon leakage of water from the chamber through the adjacent shaft seal.

5. The combination of claim 1 wherein said base member of said impeller unit includes a central hub portion and an intermediate inclined portion and an outer flat radial portion, said hub portion having a shaft opening, said radial blades being integrally formed with the inclined portion and flat radial portion and having a correspondingly shaped outer radial edge, said intermediate pump housing member having corresponding inclined and flat wall portions between said inner wall and said outlet passage wall.

6. The combination of claim 5 wherein said impeller unit includes a plastic mounting hub slidably mounted on the inner end of the impeller shaft, said innermost end of said shaft being threaded, a clamping nut threaded onto the end of the shaft, and a dished spring member located between the impeller and the clamping nut and deflected by said nut to firmly clamp the impeller to the shaft with a maximum pressure on said plastic hub in accordance with the deflection of said spring member.

7. In the combination of claim 6 including a shaft seal unit in said shaft opening in said engine cover and including a pair of axially spaced shaft seals, and an indicating passageway in said cover extending from said opening between said seals to the exterior of said cover to provide a water stream upon leakage of water from the chamber through the adjacent shaft seal.

* * * * *